US011274353B2

(12) United States Patent
van der Burgh et al.

(10) Patent No.: US 11,274,353 B2
(45) Date of Patent: Mar. 15, 2022

(54) ENVIRONMENTALLY FRIENDLY CHROME-TANNING METHOD

(71) Applicant: Smit Tanning Holding B.V., Weesp (NL)

(72) Inventors: Stefan van der Burgh, Tiel (NL); Jordi Armengol, Barcelona (ES)

(73) Assignee: Smit Tanning Holding B.V., Weesp (NL)

( * ) Notice: Subject to any disclaimer, the term of this patent is extended or adjusted under 35 U.S.C. 154(b) by 26 days.

(21) Appl. No.: 15/564,554

(22) PCT Filed: Feb. 18, 2016

(86) PCT No.: PCT/EP2016/053403
§ 371 (c)(1),
(2) Date: Oct. 5, 2017

(87) PCT Pub. No.: WO2016/131894
PCT Pub. Date: Aug. 25, 2016

(65) Prior Publication Data

US 2018/0094330 A1 Apr. 5, 2018

(30) Foreign Application Priority Data

Feb. 19, 2015 (EP) ..... 15155708

(51) Int. Cl.
*C14C 3/06* (2006.01)
*C14C 3/04* (2006.01)

(52) U.S. Cl.
CPC . *C14C 3/06* (2013.01); *C14C 3/04* (2013.01)

(58) Field of Classification Search
CPC ..... C14C 3/04; C14C 3/06
See application file for complete search history.

(56) References Cited

U.S. PATENT DOCUMENTS

| | | | | |
|---|---|---|---|---|
| 2,746,837 A * | 5/1956 | Kirk | C14C 3/22 | 525/327.6 |
| 3,373,109 A | 3/1968 | Frilette et al. | | |
| 4,221,564 A | 9/1980 | Plapper et al. | | |
| 4,264,319 A | 4/1981 | Plapper et al. | | |
| 6,241,994 B1 * | 6/2001 | Lee | A01N 43/78 | 424/404 |
| 2004/0031106 A1 * | 2/2004 | Sundar | C14C 3/06 | 8/115.51 |
| 2006/0101584 A1 * | 5/2006 | Hueffer | C14C 3/16 | 8/94.19 R |
| 2013/0000370 A1 * | 1/2013 | Lang | C05D 9/02 | 71/23 |
| 2013/0081211 A1 * | 4/2013 | Bagiran | C14C 3/04 | 8/94.29 |

FOREIGN PATENT DOCUMENTS

| | | | | |
|---|---|---|---|---|
| EP | 2 574 682 | | 4/2013 | |
| EP | 3 059 327 | | 8/2016 | |
| JP | S60-40478 B | * | 9/1985 | C14C 3/06 |
| SU | 1 675 334 | | 9/1991 | |
| WO | 2013/114414 | | 8/2013 | |
| WO | 2014/162059 | | 10/2014 | |
| WO | WO2014/162059 | * | 10/2014 | C14C 3/04 |

OTHER PUBLICATIONS

Chen Derwent 2013-D14856, 2013.*
Derwent 1984-110074, 1985.*
Ciambelli, et al.; "Zeolite-Chrome Tanning: From Laboratory to Pilot Scale"; Studies in Surface Science and Catalysis; vol. 155; 2005; pp. 189-198.
Notification of Transmittal of the International Search Report and the Written Opinion of the International Searching Authority dated May 13, 2016 for International Application No. PCT/EP2016/053403.

* cited by examiner

*Primary Examiner* — Amina S Khan
(74) *Attorney, Agent, or Firm* — N.V. Nederlandsch Octrooibureau; Tamara C. Stegmann; Catherine A. Schultz

(57) ABSTRACT

A method for tanning a hide wherein said method comprises treating a tannable hide with a tanning composition comprising from 25 to 75% by weight (wt. %) of at least one chromium(III) salt; from 5 to 70% by weight (wt. %) of at least one zeolite having the general formula (1): $Mx/n\ [(AlO_2)x(SiO_2)y]\ wH_2O$, wherein M is an alkali metal cation, a bivalent cation, a trivalent cation or a mixture thereof, n is the valence of the cation, w is the number of water molecules per unit cell, y is a number from 0.8 to 50 and the ratio y to x is ranging from 0.7 to 100, treated with at least one acid selected from the group consisting of a monocarboxylic acid and a polycarboxyic acid; and from 1 to 70 wt. % of at least one aluminium(III) salt; wherein all wt. % are relative to the total weight of the composition (T).

9 Claims, No Drawings

ENVIRONMENTALLY FRIENDLY CHROME-TANNING METHOD

CROSS REFERENCE TO RELATED APPLICATIONS

This application is the national stage filing under 35 U.S.C. § 371 of PCT/EP2016/053403, filed Feb. 18, 2016, which claims priority to European Patent Application 15155708.9, filed Feb. 19, 2015, the contents of which are incorporated herein by reference in their entirety.

FIELD OF INVENTION

The present invention relates to environmentally friendly method for tanning a leather hide including the use of chromium(III) salt based compositions, whereby said tanned leathers have improved chromium fixation and produces waste waters having a considerable reduction of chromium concentrations. The present invention further relates to a tanned hide and finished tanned leathers.

BACKGROUND OF THE INVENTION

Tanning is a process stage in the manufacture of durable leather from animal skins. In tanning the protein stability of the skin is permanently improved. The tanning process aims at, in addition to avoiding rottening of the skin, increasing resistance to water, humidity and usage together with increasing flexibility, anti-allergenic properties and visual attractiveness. Pretreatment processes are required before tanning can take place such as liming/unhairing, deliming and/or pretanning processes like bating, decreasing, and bleaching which are typically included in the processing stages.

Presently, chromium tanning with basic chromium sulphate is still the dominating technology in leather tanning, for several reasons: chromium sulphate is a cheap chemical, it is easy to apply and it provides good leather properties, i.e. high shrinkage temperatures, good touch, feel and mechanical properties.

Prior to the introduction of the basic chromium sulphate, several steps are required to produce a tannable hide including liming, introduction of alkaline agents such as calcium and/or sodium hydroxide, deliming, restoring neutral pH, bating, or softening the skin with enzymes, and pickling i.e. lowering pH of the hide using salt with formic and sulphuric acids. The pH is very acidic when chromium sulphate is introduced to ensure that chromium sulphate can diffuse into the finest hierarchy of the collagen (micro)fibre structure. When this diffusion process is complete, the pH is gradually increased to around 4, by adding slow acting alkaline agents such as sodium bicarbonate, or magnesium oxide. This pH increasing process step is called basification. At this stage, the chromium needs to bind to the carboxylic groups of the collagen, and to be locked into place by the sulfate ions. However, the affinity of chromium sulfate for the collagen is relatively low, and large quantities of chromium remain in the tanning float after basification. Thus, the conventional chromium tanning processes only achieves exhaustion levels of 40-70% of chromium.

It is known that for the leather industry said high chromium content in the tanning waste water forms a major problem.

A way of dealing with this problem, which is a known practice in the more developed countries such as in Europe and the United States, is the removal of the chromium from the effluent stream in a post processing step by using notably expensive water treatment facilities.

At the other side, several new chrome-free tanning technologies and chrome-free tanning agent compositions have been developed with the aim to improve the environmental performance of the leather tanning industries.

The use of chrome-free tanning agent compositions based on zeolites treated with monocarboxylic acid in the manufacturing of chromium-free leather has notably been described in EP 2 574 682 A1 and WO 2014/162059 A1.

WO 2013/114414 describes the use of aluminosilicates in combination with neutralizing agents and tanning materials to obtain skins free from chromium tanning and retanning.

These chromium-free tanning technologies are indeed a good solution to overcome the chromium-related problems. The drawbacks of these technologies is that the properties of the leather, both in feel/touch (i.e. fullness, softness, and flexibility), as well as technical properties such as tear strength, heat resistance (i.e. lower shrinkage temperature) are today still partly compromised.

P. Ciambelli et a. (Studies in Surface Science and Catalysis, Volume 155, 2005, pages 189-198) describes a combined use of zeolite and chromium sulphate (i.e. chrome-zeolite tanning process) both on laboratory scale and on pilot scale resulting in higher tanning rates and higher float exhaustion.

The laboratory tanning tests have been carried out at (i) different zeolite concentrations (i.e. ranging from 1 to 3 wt % relative to the fleshed pelt weight) in combination with an initial bath chromium concentration of 29.1 g $l^{-1}$ and (ii) at different initial bath chromium concentrations (i.e. 13.6 g 18.0 g $l^{-1}$ and 27.1 g $l^{-1}$) in combination with 3 wt % of zeolite. In particular, at 18.0 g $l^{-1}$ chromium initial concentration, after 24 hours, a chromium exhaustion of about 80% and a chromium concentration in the residual float of 1.4 g $l^{-1}$ was obtained. On pilot scale, the tanning process carried out using the operating conditions of 3 wt % of zeolite A, relative to the fleshed pelt weight combined with an initial bath chromium concentration of 27.8 g $l^{-1}$ and a bath volume-pelt mass ratio of 0.93 ml/g, initial pH=3, enables a chromium exhaustion of 94% to be obtained after 24 hours (leaving a residual chromium concentration of 1.67 g l-1). Despite the improved chromium exhaustion, the residual chromium concentrations in the floats are still very high in the range of about 1.4 g $l^{-1}$ to 2.1 g $l^{-1}$.

U.S. Pat. No. 4,264,319 discloses a process of tanning for the production of dressed fur skins. Pickled fur skins are subjected to the action of an aqueous liquor containing both tanning agents and chromium salts. A water-insoluble aluminosilicate containing bound water, of the formula $(Cat_{2/n}O)_x.Al_2O_3.(SiO_2)_y$ wherein Cat represents a cation selected from the group consisting of alkali metals, bivalent metal ions, trivalent metal ions and mixtures thereof; n represents an integer from 1 to 3; or x is a number from 0.5 to 1.8; and y is a number from 0.8 to 50, is added to the pickling bath as the tanning agent. Specifically, working example 1 of U.S. Pat. No. 4,264,319 shows that the combined use of 3 wt % of aluminosilicate A (i.e. 0.9 $Na_2O$.1 $Al_2O_3$.2.04 $SiO_2$.4.3 $H_2O$) with 6 wt % of chromium sulphate (i.e. Chromosal B® by Bayer AG) enables a residual chromium content in the liquor of 0.3 to 0.9 g $l^{-1}$ of chromium oxide (i.e. $Cr_2O_3$) to be achieved.

It should be mentioned that the limitations for permissible chromium concentrations in waste water enforced by the environmental regulatory agencies in many countries become very stringent. The tanneries have more and more difficulties to comply with the new environmental legislation, One typical example is China, where as of Jul. 1, 2014 the Chinese legislation, imposes a maximum chromium concentration in waste water of 1.5 mg/l chromium oxide (i.e. $Cr_2O_3$).

Parallel to that, legislation will be enforced in the European Union that prohibits chromium VI in any leather articles that will come in direct contact with the skin, on the European market. Chromium VI is the oxidized hexavalent state of chromium III and is considered a very serious health risk. Yet, it has been found with many articles in the shops, that chromium VI is still above these new legal limits.

Therefore, there is a further need to provide environmentally friendly and economically practical methods in which tanning compositions comprising chromium (III) salts can be used to produce tanned leathers whilst enabling a considerable reduction of chromium concentrations in the waste water originating from said leather tanning methods, and whereby said tanned leathers have improved chromium fixation, excellent leather properties such as softness, firmness, touch and feel.

SUMMARY OF THE INVENTION

The Applicant has now surprisingly found that it is possible to provide a method fulfilling the above mentioned needs.

It is thus an object of the present invention a method for tanning a leather hide [hide (H), herein after] wherein said method comprises treating a tannable hide [hide ($H_t$), herein after] with a tanning composition [composition (T), herein after] comprising:

- from 25 to 75% by weight (wt. %) of at least one chromium(III) salt,
- from 5 to 70% by weight (wt. %) of at least one treated zeolite [treated zeolite (Z), herein after] prepared by treating at least one zeolite [zeolite (Z), herein after) having the general formula (1): $M_{x/n}$ $[(AlO_2)_x(SiO_2)_y]$ $wH_2O$, wherein M is an alkali metal cation, a bivalent cation, a trivalent cation or a mixture thereof, n is the valence of the cation, w is the number of water molecules per unit cell, y is a number from 0.8 to 50 and the ratio y to x is ranging from 0.7 to 100 with at least one acid [acid (C), herein after) selected from the group consisting of a monocarboxylic acid and a polycarboxylic acid,
- from 1 to 70 wt. % of at least one aluminium(III) salt, and wherein all wt. % are relative to the total weight of the composition (T).

Another object of the present invention is directed to a tanned hide prepared according to the method of the invention.

Another object of the present invention is directed to a tanning composition suitable for use in a method for tanning a hide and the manufacturing thereof.

The Composition (T)

In the rest of the text, the expression "chromium(III)salt" is understood, for the purposes of the present invention, both in the plural and the singular, that is to say that the inventive composition may comprise one or more than one chromium (III)salt. It is understood that the same applies for the expressions "treated zeolite (Z)", "aluminium(III)salt" and the "acid (C)".

Chromium(III)salt, especially chromium alum and chromium(III) sulfate, are generally used in chromium-tanning of leather.

33% basic chromium(III)sulphate containing 26% of chromium oxide in power form is especially preferred.

The use of chromium(III) salts alone in the tanning of hides leads to very high quality leathers but the amount of the residual chromium oxide in the liquor is as high as about 4000 mg/l.

The Applicant has now surprisingly found that the tanning method of the present invention, enables the use of the chromium(III)salt, in particular chromiurn(III) sulfate, in a broad concentration range from 25 to 75% by weight (wt. %) relative to the total weight of the composition (T), in order to obtain the desired leather properties, such as both in feel/touch (i.e. fullness, softness, and flexibility), as well as the technical properties such as tear strength, heat resistance (i.e. higher shrinkage temperature) while also achieving a very low residual chromium content in the liquor of as low as 45 mg/l of chromium oxide.

According to certain embodiments in the method of the present invention, the chrornium(III)salt, in particular chrornium(III) sulfate, is used in a concentration range from 35 to 75% wt. %, relative to the total weight of the composition (T), to achieve a better leather quality, preferably from 40 to 65 wt. %, to achieve an optimal balance between obtaining a very good leather quality and a considerable reduction of the residual chromium content in the liquor.

The inventors have found that said optimal balance between a very good leather quality and considerable reduction of the residual chromium content can be obtained because the chromium(III) salt, in particular chromium(III) sulfate, is used in combination with a specific mixture of acid treated zeolites and an aluminium(III)salt, as explained in detail below.

Thus, in the method of the present invention use is made of at least one zeolite (zeolite (Z)) having the general formula (1): $M_{x/n}$ $[(AlO_2)_x(SiO_2)_y]$ $wH_2O$, wherein M is an alkali metal cation, a bivalent cation, a trivalent cation or a mixture thereof, n is the valence of the cation, w is the number of water molecules per unit cell being a number from 1 to 10, y is a number from 0.8 to 50 and the ratio y to x is ranging from 0.7 to 100.

Preferably, M is an alkali metal cation or an earth alkaline metal cation. More preferably, M is a Na, K, Ca or Ba cation.

Presently, about 200 unique zeolite frameworks are identified and over 40 naturally occurring frameworks are known. Zeolites having the general formula (1), as detailed above, are crystalline alurninosilicates with open 3D framework structures built of $SiO_4$ and $AlO_4$ tetrahedra linked to each other by sharing all the oxygen atoms to form regular intra-crystalline cavities and channels of molecular dimensions.

Suitable zeolites (Z) of the general formula (1), as defined above, are notably described in U.S. Pat. Nos. 3,373,109 and 4,264,319 the whole content of those are herein incorporated by reference.

The zeolites (Z) of the present invention may be classified according to their Si/Al ratio, that is to say according to their y/x ratio as defined in general formula (1), as detailed above.

According to a first preferred embodiment of the method according to the present invention, use is made of a zeolite (Z) according to formula (1), as detailed above, wherein M is an alkali metal cation or an earth alkaline metal cation, preferably M is an alkali metal cation, in particular M is a sodium cation, w is the number of water molecules per unit cell being a number from 1 to 10, y is a number from 0.8 to 15, more preferably y is a number from 0.8 to 6, w is a number from 1 to 5 and the ratio y to x is ranging from 0.7 to 6, preferably the ratio y to x is from 0.7 to 2.5, preferably the ratio y to x is from 0.7 to 1.2, and more preferably y to x from 0.7 to 1,1 such as from 0.9 to 1.1 or very close to unity.

Typical zeolites (Z) suitable for use in the method of the invention according to this first preferred embodiment and wherein said zeolites (Z) are having a Si/Al ratio ranging from 0.7 to 6, may include, but not limited to zeolite A ($Na_2O.Al_2O_3.2SiO_2,4.5H_2O$), zeolite H ($K_2O.Al_2O_3$, $2SiO_2.4.0H_2O$), zeolite X ($Na_2O.Al_2O_3.2.5SiO_2.6H_2O$), zeolite Y (i.e. $Na_2O.Al_2O_3.4.8SiO_2.8.9H_2O$), zeolite L ($(K_2Na_2)O.Al_2O_3.6SiO_2.5H_2O$), faujasit (Ca, $Na_2$, Mg, $K_2$) ($Al_2Si_{4.1-4.6}O_{12.2-13.2}$).$4H_2O$) and mordenite ($Na_2$, Ca, $K_2$) ($Al_2Si_{9.0-10.6}O_{22.0-25.2}$).6.4-7$H_2O$) and the like, preferably Preferred zeolites (Z) are selected among zeolite A and/or zeolite X, most preferred zeolite (Z) is zeolite A.

According to a specific preferred embodiment zeolite A 4 has a pore size of 4 A.

The zeolites (Z) of this first preferred embodiment has generally a pH of at least 8, in particular at least 9, and even more particular at least 10.

The pH has been measured according to the state of the art methods.

Alternatively, if desired, in the method according to the present invention, use can also be made of a zeolite (Z) according to formula (1), as detailed above, wherein M is an alkali metal cation or an earth alkaline metal cation, y is a number from 51 to 100, w is the number of water molecules per unit cell being a number from 1 to 20 and the ratio y to x is higher than 2 and less than 100. ZSM-5, Zeolite Socony Mobil-5, is a typical example of such zeolite.

The zeolite (Z), as described above, has preferably a low moisture content of less than 20% by weight, more preferably less than 15%, most preferably less than 10%, such as less than 8%, before being subjected to the acid (C) treatment, The lower the water content, the better the adsorption potential of the acid (C), as mentioned above, leading to enhanced flowability of the treated zeolite (Z). Thus, the zeolite (Z) may be dried, preferably oven dried, before subjecting it to the acid (C) treatment.

As said, the treated zeolite (Z) is prepared by subjecting the zeolite (Z), as described above, to an acid treatment by using at least one acid [acid (C), herein after) selected from the group consisting of a monocarboxylic acid, a polycarboxylic acid, and mixtures thereof.

Said acid treatment of the zeolite (Z), as described above, can be carried out according to known practice in the art.

Advantageously, the zeolite (Z) and the acid (C) are mixed with each other.

It is further understood that the zeolite (Z) does not react with the acid (C) and that the zeolite structure remains intact after the treatment with the acid (C) (i.e. the analysis shows that no breakdown or disintegration takes place).

In general, the use of a concentrated acid (C) is preferred. Preferably, the concentration of the acid (C) to be used is 84% by weight or more, more preferably 90% or more, most preferably 95% or more, such as 99%. A concentrated acid (C) is preferred in order to provide as low moisture content for the treated zeolite (Z) as possible.

According to a preferred embodiment of the present invention, the acid (C) is a concentrated rnonocarboxylic acid, preferably a concentrated aliphatic monocarboxylic acid.

Non-limiting examples of suitable aliphatic monocarboxylic acid may include, but not limited to, formic acid, propionic acid, glycolic acid, acetic acid.

The concentrated aliphatic monocarboxylic acid is preferably a 99% by weight formic acid, a 99% by weight propionic acid or a 99% by weight acetic acid, more preferably a 99% by weight formic acid.

It is understood by the skilled in that art that the expression "a 99% by weight formic acid" refers to formic acid having a water content of below 1% by weight. It is understood that the same applies for the expressions "a 99% by weight propionic acid" and "a 99% by weight acetic acid".

According to a particular embodiment of the present invention, the acid treatment of the zeolite (Z), as described above, with the concentrated aliphatic monocarboxylic acid can be carried out by the preparation method as notably described in EP 2 574 682 A1 and WO 2014/162059 A1, the whole content of those are herein incorporated by reference.

In particular, the zeolite (Z) is introduced into a reactor, or another vessel suitable for withstanding the required treatment conditions. The provided zeolite (Z) is kept in motion while the concentrated aliphatic monocarboxylic acid is introduced onto the zeolite (Z) residing inside the reactor while controlling the temperature. In general, the mixing of the concentrated aliphatic monocarboxylic acid is conducted by spraying which is slowly and uniformly enough in order to ensure that a homogenous solid powdery treated zeolite (Z) is obtained and maintained, similar to the original zeolite (Z) powder, and simultaneously the temperature of this mixture may be controlled. The temperature of the mixture should stay low enough, at a critical value of 80° C. or below, preferably below 50° C., to avoid unwanted reactions to take place as the treatment of the zeolite (Z) with the concentrated aliphatic monocarboxylic acid is exothermic.

For the purpose of the present invention, the term "spray" is meant to refer to a small droplet size atomised liquid flow. A spray is generally taken to mean a dynamic collection of drops dispersed in gas. The process of forming a spray is called atomisation. A spray nozzle is typically used to generate the spray. The main characteristics of the spray is to distribute the material over a specified cross section and to generate a liquid surface area. A man skilled in the art is able to select the most appropriate spray technology depending on the reactor configuration. Preferably, a suitable spray is provided by a nozzle atomizer capable of injecting a spreading spray with a small droplet size, preferably in the range from 0.01 to 1 mm diameter. The mass transfer rate of the acid may be adjusted by measuring the temperature of the resulting zeolite-acid mixture and setting the mass transfer rate into a value wherein this temperature is still below the critical value. Spraying may be performed continuously or discontinuously. The zeolite (Z) needs to be in motion inside the reactor. Preferably, this motion is vigorous enough in order to ensure good uniformity for the acid contact and to avoid generation of local hot spots. A preferred option is to use a drum reactor or the like wherein the rotation speed may be adjusted according to the mixing needs. A skilled person is able to optimize the mixing to maintain a uniform temperature below the critical value. In a preferred embodiment the reactor is equipped with a cooling system to ensure that the temperature of the mixture is maintained below the critical temperature. More preferably, a drum reactor with a cooling casing or jacket is utilised. There are several other commercially available options for cooling in a reactor set up suitable for the present use which may be applicable and within the expertise of a skilled person.

According to another embodiment of the present invention, the acid (C) is a polycarboxylic acid.

For the purpose of the present invention, the term "polycarboxylic acid" is intended to denote a carboxylic acid having at least two carboxyl groups, optionally having at least one ester group and/or at least one urethane group and/or at least one amide group.

Suitable polycarboxylic acids for use in the acid treatment of the zeolite (Z) are notably described in U.S. Pat. Nos. 3,373,109 and 4,264,319.

Preferably, the polycarboxylic acid is a dicarboxylic acid wherein said dicarboxylic acid can be aliphatic or aromatic, preferably aliphatic, Non-limiting examples of suitable aliphatic dicarboxylic acid may include, but not limited to, oxalic acid, adipic acid, citric acid, maleic acid, tartaric acid, malic acid.

The ratio of the acid (C) to the zeolite (Z) is preferably from 5 to 50% by weight, The ratio is to some extent dependent on the quality of the acid used.

According to a preferred embodiment of the present invention, the ratio of the concentrated aliphatic monocarboxylic acid to the zeolite (Z) is from 5 to 50% by weight, more preferably from 5 to 40% by weight, even more preferably from 7 to 35% by weight, most preferably from 10 to 30% by weight.

According to a particular preferred embodiment, the ratio of the 99% by weight formic acid to the zeolite (Z) having a Si/Al ratio ranging from 0.7 to 6, as mentioned above, is from 7 to 30%, more preferably from 8 to 28%, even more preferably from 10 to 25%.

Generally, the composition (T) as used in the method according to the invention, comprises the treated zeolite (Z), as described above, in an amount equal to or of at least 5 wt. %, preferably equal to or of at least 7 wt. %, more preferably equal to or of at least 10 wt., relative to the total weight of the composition (T).

It is further understood that the weight percent of the treated zeolite (Z), relative to the total weight of the composition (T) is generally less than 60 wt. %, preferably less than 50 wt. %, more preferably less than 40 wt. %, even more preferably less than 30 wt. %.

Good results were obtained when the composition (T) comprised the treated zeolite (Z) in an amount of 7 wt. % to 30 wt. %, relative to the total weight of the composition (T).

The combined use of the treated zeolite (Z) with the chromium(III) salt, in particular chromium(III) sulfate, already leads to a reduction of the residual chromium content in the liquor while maintaining good leather properties. However, the partial replacement of the more expensive treated zeolite (Z), as detailed above, by the cheaper aluminium(III) salts further results in an increased reduction of the residual chromium content in the liquor to values as low as 45 mg/l of chromium oxide in said liquor, while maintaining excellent leather properties such as softness, firmness, touch and feel.

In other words, the combined use of a chromium(III) salt, in particular chromium(III) sulfate with treated zeolites (Z), as described above, and aluminium(III) salts and that in specific quantities, results in an environmentally friendly and economically practical method for tanning hides and skins in which the composition (T) of the present invention can be used to produce excellent quality tanned leathers. In particular, the Inventors have surprisingly found that the method according to the invention is especially effective in the immobilization of chromium.

The aluminium (III) salt comprised in the composition (T) of the method of the present invention is advantageously chosen among aluminium (III) sulphate, aluminium (III) chloride, aluminium (III) nitrate. Aluminium (III) sulphate is especially preferred.

Generally, the composition (T) as used in the method according to the invention, comprises the aluminium(III) salt, in particular aluminium (III) sulphate, in an amount equal to or of at least 5 wt. %, preferably equal to or of at least 7 wt. %, more preferably equal to or of at least 10 wt., even more equal to or of at least 15 wt., preferably relative to the total weight of the composition (T).

It is further understood that the weight percent or the aluminium(III) salt, in particular aluminium (III) sulphate, relative to the total weight of the composition (T) is generally less than 60 wt. %, preferably less than 50 wt. %, more preferably less than 40 wt. %, even more preferably less than 30 wt. %.

Good results were obtained when the composition (T) comprised the aluminium(III) salt, in particular aluminium (III) sulphate in an amount of 7 wt. % to 30 wt. %, relative to the total weight of the composition (T). Excellent results were obtained when the composition (T) comprised the aluminium(III) salt, in particular aluminium (III) sulphate in an amount of 15 wt. % to 30 wt. %, relative to the total weight of the composition (T).

Advantageously, the weight ratio of the aluminium(III) salt, in particular aluminium (III) sulphate to the treated zeolite (Z) is greater than 0.05, preferably greater than 0.1, more preferably greater than 0.5, even more preferably greater than 1.0, yet even more preferably greater than 1.1, most preferably greater than 1.2.

According to certain embodiments of the method according to the present invention, the composition (T) may further comprise other ingredients [ingredient (I), hereinafter], to improve further the final properties of the tanned hides and skin.

Typical ingredients (I) may include, but not limited to, complexation agents and slow acting bases.

Typically, the amount of the ingredient (I), when present, is from 0.1 to 20% by weight, more preferably from 0.1 to 10% by weight, most preferably from 0.1 to 6% by weight, relative to the total weight of the composition (T).

According to certain embodiments of the method of the present invention, the composition (T) may further comprise at least one complexation agent selected from the group consisting of an aliphatic carboxylic acid having at least one pKa value from 2.7 to 5.3, EDTA, DTPA, a phosphonic acid, an amino-acid, a polypeptides based on amino acids, a polysilicic acid, a resin syntan, an oligomeric condensation resin.

More preferably, the complexation agent is an aliphatic carboxylic acid having at least one pKa value from 2.7 to 5.3 selected from the group consisting of citric acid, make acid, tartaric acid, glycolic acid, lactic acid, phtalic acid, acrylic acid. Most preferably, the complexation agent is citric acid, malic acid or tartaric acid. Citric acid is most preferred complexation agent.

If desired, the complexation agent may be added to provide additional buffering in the system and to improve fixing the chromium in the collagen structure.

Typically, the amount of the complexation agent, when present, is from 0.1 to 10% by weight, more preferably from 0.1 to 5% by weight, most preferably from 0.1 to 3% by weight, relative to the total weight of the composition (T).

According to certain embodiments of the method of the present invention, the composition (T) may further comprise at least one slow acting base.

For the purpose of the present invention, the term "slow acting base" refers to any base capable of providing a gradual and/or smooth basification reaction throughout the entire cross-section of the hide or skin, without an overloading of tanning agent on the grainside of the hide.

Preferably, the slow acting base is magnesium oxide.

Typically, the amount of the slow acting base, when present, is from 0.1 to 15% by weight, more preferably from 0.5 to 10% by weight, most preferably from 1 to 8% by weight, relative to the total weight of the composition (T).

According to a particular embodiment of the present invention, the composition (T), as used in the method of the present invention, comprises, preferably consists essentially of:

- from 35 to 75% by weight (wt. %) of at least one chromium(III) sulfate,
- from 7 to 50% by weight (wt. %) of at least one treated zeolite [treated zeolite (Z), herein after] prepared by treating at least one zeolite [zeolite (Z), herein after) having the general formula (1): $M_{x/n}$ $[(AlO_2)_x(SiO_2)_y]$ $wH_2O$, wherein M is an alkali metal cation or an earth alkaline metal cation, n is the valence of the cation, w is the number of water molecules per unit cell, y is a number from 0.8 to 15 and the ratio y to x is ranging from 0.7 to 6 with at least one monocarboxylic acid, as defined above,
- from 7 to 50 wt. % of at least one aluminium(III) sulphate
- from 0.1 to 5 wt. % of at least one complexation agent wherein said complexation agent is an aliphatic carboxylic acid having at least one pKa value from 2.7 to 5.3 selected from the group consisting of citric acid, malic acid, tartaric acid, glycolic acid, lactic acid, phtalic acid, acrylic acid,
- from 0.5 to 10 wt. % of at least one slow acting base, preferably magnesium oxide wherein all wt. % are relative to the total weight of the composition (T).

For the purpose of the present invention, the expression "consists essentially of" are intended to denote that any additional ingredient different from chromium(III) sulfate, the treated zeolite (Z), as detailed above, aluminium(III) sulphate, the complexation agent, as detailed above, and the slow acting base, as detailed above is present in an amount of at most 1% by weight, based on the total weight of the composition (T).

Another aspect of the present invention is the composition (T), as defined above, for use in the method of the present invention.

It is generally known that prior to the tanning stage, several steps are carried out to produce a tannable hide including notably scudding, liming, introduction of alkali agents such as calcium and/or sodium hydroxide, deliming, restoring neutral pH, bating, or softening the skin with enzymes, and pickling i.e. lowering pH of the hide with salt and formic acid and sulphuric acid.

In an advantageous embodiment of the present invention, the method of the present invention comprises the steps of:

Step 1. subjecting a hide (H) to a beam house treatment, thereby obtaining a tannable hide [hide ($H_t$), herein after], and Step 2. treating the hide ($H_t$), as formed in Step 1, with the composition (T), as detailed above, thereby obtaining a tanned hide and a waste solution.

For the purpose of the present invention, the term "beam house treatment" is intended to denote all the steps in the production of leather between the raw hides and prior to tanning.

Regular beamhouse operations typically include soaking, liming, removal of extraneous tissues i.e. unhairing, scudding, and fleshing, deliming, bating, drenching, and pickling.

For the purpose of the present invention, the term "pickling" refers in general to the known regular pickling stage and the modified pickling stage wherein in latter pickling stage the salt concentration is less than in a regular pickling stage, such as notably described in WO 2014/162059 A1, the whole content of which is herein incorporated by reference.

In general, the hide (Ht), formed in Step 1. of the method of the present invention, is present in an aqueous solution having a pH from 2.5-4.0, preferably from 2.7 to 3.3 [aqueous solution 1, hereinafter].

In the rest of the text, the expression "aqueous solution 1" refers, for the purposes of the present invention, to the aqueous solution having a pH from 2.5-4.0 containing the hide ($H_t$), formed in Step 1. of the method of the present invention.

In a preferred embodiment of the method according to the present invention, the weight percent of the composition (T) as used in the treatment of the hide ($H_t$) is generally equal to or at least 2 wt. %, preferably equal to or at least 3 wt. %, more preferably equal to or at least 4 wt. %, even more preferably equal to or at least 5 wt. %, relative to the hide ($H_t$) mass to which the composition (T) is added.

It is further understood that the weight percent of the composition (T) relative to the hide ($H_t$) mass to which it is added, will generally be equal to or at most 20 wt. %, more preferably equal to or at most 15 wt. %, even more preferably equal to or at most 10 wt. %.

Good results were obtained when the hide ($H_t$) is treated with the composition (T) in an amount of 4 wt. %-14 wt. % relative to the hide ($H_t$) mass to which it is added.

In Step 2, of the method of the present invention, the different components of the composition (T), are advantageously added and mixed (i.e. admixing) into the aqueous solution 1, containing the hide (Ht), in a hide tanning vessel.

It is further understood that the different components of the composition (T) can be introduced into the hide (Ht) while said hide (Ht) is present in the aqueous solution 1.

The Inventors have surprisingly found that the admixing of the composition (T), into the aqueous solution 1, as detailed above, provides an increase in the pH of the aqueous solution 1 to a value of at least 4.0, preferably of at least 4.2, more preferably of at least 4.5, even more preferably of at least 4.7.

It is further understood that the pH of the aqueous solution 1 is typically less than 5.5 after admixing of the composition (T), into the aqueous solution 1.

While any order of admixing may be used, it is typically useful to add first the chromium(III) salt to the aqueous solution 1, as detailed above, prior to adding at the same time or sequentially the remaining components of the composition (T). In general, the admixing is carried out at room temperature.

It is further understood that the skilled person in the art will carry out said admixing according to general practice such as notably applying optimal time periods for addition and mixing of the chromium(III) salt, as detailed above, the treated zeolite (Z), as detailed above, the aluminium(III) salt, as detailed above, optionally, other ingredients (I), as detailed above, including optionally the cornplexation agent, as detailed above and optionally, the slow acting base, as detailed above, into the hide tanning vessel comprising the aqueous solution 1, as detailed above.

According to a particular preferred embodiment in Step 2. of the method of the present invention, the treatment of the hide ($H_t$) with the composition (T) comprises the admixing of the components of the composition (T) in 2 consecutive steps, optionally 3 consecutive steps, of: step (a) admixing the chromium(III) salt, as detailed above, into the aqueous solution 1 during a time period to of from 30 to 240 min, preferably from 40 to 200 min, more preferably from 50 to 100 min thereby forming an aqueous solution 2; step (b) admixing the treated zeolite (Z), as detailed above, the aluminium(III) salt, as detailed above, the complexation agent, as detailed above, into said aqueous solution 2, during a time period $t_b$ of from 60 to 500 min, preferably from 100 to 480 min, more preferably from 180 to 420 min thereby forming an aqueous solution 3; and optionally step (c) admixing the slow acting base, as detailed above, into said aqueous solution 3, during a time period $t_c$ of from 1 to 18 hours, preferably from 5 to 15 hours, more preferably from 6 to 10 hours thereby forming a final aqueous solution comprising the tanned hide. Subsequently, the tanned hide is removed from the final aqueous solution and the residual aqueous solution typically becomes the waste solution.

If desired, step (b), as detailed above, may be realized by several sequential additions of the treated zeolite (Z), as detailed above, the aluminium(III) salt, as detailed above, and the complexation agent, as detailed above, in a way as notably described in WO 2014/162059 A1.

In general, the admixing of the chromium(III) salt, as detailed above, into the aqueous solution 1, as detailed above, in step (a) lowers the pH over a pH range of 0.1 to 0.5, preferably 0.2 to 0.4.

On the contrary, the admixing the treated zeolite (Z), as detailed above, the aluminium(III) salt, as detailed above, the complexation agent, as detailed above, into said aqueous solution 2 in step (b) increases the pH over a pH range of 0.5 to 2.0, preferably 0.5 to 1.5, more preferably 0.6 to 0.9.

The Inventors have surprisingly found that the method according to the invention is especially effective in the immobilization of chromium in the tanned hide. This being said, the tanned hide may contain high levels of fixed chromium.

Advantageously, the chromium exhaustion of the chromium(III) salt in the final aqueous solution is of at least 90%, preferably at least 94%, more preferably at least 98.5%.

Advantageously, the waste solution may comprise a residual chromium content of less than 300 mg/l of chromium oxide (i.e. $Cr_2O_3$), preferably less than 250 mg/l of $Cr_2O_3$, more preferably less than 200 mg/l of $Cr_2O_3$, even more preferably less than 150 mg/l of $Cr_2O_3$ and most preferably less than 100 mg/l of $Cr_2O_3$.

For the purpose of the present invention, the chromium content of the waste solution has been determined by Atomic Absorption Spectrometric Methods (AAS) according to a standard method UNE-EN 1233.

The Tanned Hide

As said, another aspect of the present invention is directed to a tanned hide prepared according to the method of the invention, as described in detail above.

The Inventors have surprisingly found that the method according to the invention is especially effective in the immobilization of chromium in the tanned hide. This being said, the tanned hide may contain high levels of fixed chromium.

The tanned hide according to the invention may be further processed, retanned, dyed, fat liquored and finished into a finished tanned leather according to known practice in the art, and depending on the desired end use.

Typical further processing steps include, but not limiting to, splitting, shaving, neutralization, samming, setting out, wet-end, drying, and mechanization.

For example, the grain leathers from the shaving machine are then separated for retanning, dyeing, and fat liquoring. Fat liquoring is known as the process of introducing oil into the skin before the leather is dried to replace the natural oils lost in the beam house and lanyard processes. After fat liquoring, the tanned leather is wrung, set out, dried, and finished.

Thus, the finishing process refers to all the steps that are carried out after drying and notably includes buffing with fine abrasives to produce a suede finish; waxed, shellacked, or treated with pigments, dyes, and resins to achieve a smooth, polished surface and the desired color; or lacquered with urethane for a glossy patent leather. Water-based or solvent-based finishes may also be applied to the leather. Plating is then used to smooth the surface of the coating materials and bond them to the grain.

The finished tanned leather so obtained is also an object of the present invention.

EXAMPLES

The invention will be now described in more details with reference to the following examples, whose purpose is merely illustrative and not intended to limit the scope of the invention.

General Procedure for Tanning a Hide

The hides were subjected to a beamhouse process; presoaking, soaking, liming/dehairing, fleshing/splitting, deliming, bating, pickling according to known practice in the art in a beamhouse process for leather based on a tanning process with chromium (III) sulfate. The presoaking, soaking, liming and dehairing formulations were performed relative to the raw salted weight of the hides. The deliming, bating, pickling formulations were based on the weight of the splitted hides in limed stage. At the end of the bearnhouse processes, pickled hides were obtained in a in 50% aqueous solution, relative to the limed weight of the hides. Said 50% aqueous solution is also containing 0.6% formic acid 85%, relative to the limed weight, 0.9% sulfuric acid 96%, relative to the limed weight and 7% salt, relative to the limed weight. The pH obtained was between 2.8 and 3.2.

For each of the examples, as detailed below, a composition (T), as detailed below, was added to said pickled hides.

Comparative Example 1

The comparative composition had following components:

93.3 wt. % of chromium(III) sulphate ($Cr_2(SO_4)_3$ 26/33 obtained from Lanxess, thus chromium(III) sulphate having 33% basicity and 26% chromium oxide 6.7 wt. % of magnesium oxide A total of 7.5% by weight of the comparative composition, relative to the limed hide mass was introduced in the tanning vessel containing 21.4 kg of the limed hide in 50% aqueous solution, relative to the limed hide. The starting pH was 2.90.

The following dosing scheme was applied:

- step (a): 7.0% by weight of $Cr_2(SO_4)_3$ 26/33, relative to the hide (Ht) mass, was first added, running (i.e mixing) time was 180 minutes, pH after treatment was 2.97
- no step (b)
- step (c): 0.5% by weight of magnesium oxide, relative to the hide (Ht) mass, was then added, running time was 12 hours, pH after treatment was 3.98.

The chromium content of the waste solution obtained by Atomic Absorption Spectrometric Methods (AAS) according to a standard method UNE-EN 1233 was 3955 mg/l.

The chromium exhaustion was 74.20%.

The shrinkage temperature is 95° C.

Example 2

The composition (T) had following components:

- a 53.3 wt. % of $Cr_2(SO_4)_3$ 26/33 obtained from Lanxess
- 17.5 wt. % of formic acid treated zeolite A4 (zeolite A4 87% by weight treated with 13% by weight of formic acid (purity 99%, from Kemira Poland)
- 20.9 wt. % of aluminium(III) sulphate 14*$H_2O$ (from Lanxess)
- 1.6 wt. % of citric acid, anhydrous (from Brenntag)
- 6.7% of magnesium oxide A total of 7.5% by weight of the composition (T), relative to the limed hide mass was introduced in the tanning vessel containing 13.8 kg of the limed hide in 50% aqueous solution, relative to the limed hide having. The starting pH was 2.90. The following dosing scheme was applied:

- a step (a): 4.0% by weight of $Cr_2(SO_4)_3$ 26/33, relative to the limed hide mass, was first added, running (i.e mixing) time was 180 minutes, pH after treatment was 3.0
- step (b): 1.3 wt. % of formic acid treated zeolite A4, 1.6 wt. % of aluminium(III) sulphate 14*$H_2O$ and 0.1 wt. % of citric acid, anhydrous, were added together, running time was 180 minutes, pH after treatment was 3.0
- step (c): 0.5% by weight of magnesium oxide, relative to the limed hide mass, was then added, running time was 12 hours, pH after treatment was 4.90.

The chromium content of the waste solution obtained by Atomic Absorption Spectrometric Methods (AAS) according to a standard method UNE-EN 1233 was 45 mg/l.

Based on this chromium content of 45 mg/l, the average chromium content present in the accumulated waste waters over the whole process including soaking, liming, deliming, pickling and tanning is 0.8 mg/l. Thus, below the maximum allowed value of 1.5 mg/l according to the Chinese legislation as of Jul. 1, 2014.

The shrinkage temperature is 105° C.

Comparative Example 3

The comparative composition of Example 3 had following components:

- 54.8 wt. % of $Cr_2(SO_4)_3$ 26/33 obtained from Lanxess
- 40.4 wt. % of formic acid treated zeolite A4 (zeolite A4 87% by weight treated with 13% by weight of formic acid (purity 99%, from Kemira Poland)
- 0.7 wt. % of citric acid, anhydrous (from Brenntag)
- 4.1% of magnesium oxide A total of 7.3% by weight of the comparative composition of Example 3, relative to the limed hide mass was introduced in the tanning vessel containing 11.85 kg of the limed hide in 50% aqueous solution, relative to the limed hide. The starting pH was 2.80.

The following dosing scheme was applied:

- step (a): 4.0% by weight of $Cr_2(SO_4)_3$ 26/33, relative to the hide (Ht) mass, was first added, running (i.e mixing) time was 180 minutes, pH after treatment was 2.40
- step (b): 1.15 wt. % of formic acid treated zeolite A4 and 0.05 wt. % of citric acid, anhydrous, were added together, running time was 180 minutes, pH after treatment was 3.39
- step (c): 1.8 wt. % of formic acid treated zeolite A4, was added, running time was overnight, pH after treatment was 3.70
- step (c): 0.3% by weight of magnesium oxide, relative to the limed hide mass, was then added, running time was 2 hours, pH after treatment was 4.50.

The chromium content of the waste solution obtained by Atomic Absorption Spectrom was 178.1 mg/l.

The chromium exhaustion was 97.84%.

The shrinkage temperature is 108° C.

All 3 tanned hides of comparative examples 1, 3 and example 2 were further processed according to known practice in the art.

In particular, the 3 tanned hides of comparative examples 1, 3 and example 2 were sammed and shaved according to the state of the art, to a thickness of 1.0 mm.

For the wet-end process, said sammed and shaved hides were retanned using a state-of-the-art formulation for e.g. automotive seats leather or leather for sofas. The wet end formulation was based on:

- 5% Tara
- 3% Phenolic retaning
- 3% Polymeric retanning
- 4% Lecithine
- 6% Fat Liquor based on sulphite ester Drying was performed by vacuum drying (2 minutes, 45° C.), followed by hanging drying overnight and milling for 8 hours.

The organoleptic evaluation was performed on all three finished tanned leathers of comparative examples 1, 3 and example 2.

Dyeing was very good in the finished tanned leather of example 2 (color was even).

Based on the organoleptic evaluation, the finished tanned leather of example 2 was considered to be the best leather, as summarized below:

- grain tightness was better in the finished tanned leathers of example 2 and comparative example 3, compared to the finished tanned leather of comparative example 1
- softness was slightly better in the finished tanned leather of comparative example 1 compared to the finished tanned leather of example 2, and much better in the finished tanned leather of example 2 compared to the finished tanned leather of comparative example 3
- fullness was better in the finished tanned leathers of example 2 and comparative example 3, compared to the finished tanned leather of comparative example 1
- filling of difficult parts such as bellies was better in the finished tanned leathers of example 2 and comparative example 3, compared to the finished tanned leather of comparative example 1.

In conclusion, the combination of all relevant parameters for the touch and feel of the leather show an optimum in the finished tanned leather of example 2.

Tear strength for all three finished tanned leathers of comparative examples 1, 3 and example 2 was not superior, just in the "approved" level, the tensile strength was very good in all of them.

The invention claimed is:

1. A method for tanning a hide, wherein said method comprises treating a tannable hide ($H_t$) with a tanning composition (T) comprising:

- from 40 to 65% by weight (wt. %) of chromium(III) sulfate,
- from 7 to 50% by weight (wt. %) of at least one treated zeolite (Z) prepared by treating at least one zeolite (Z) having the general formula (1): $M_{x/n}$ $[(AlO_2)_x(SiO_2)_y]$ $wH_2O$, wherein M is an alkali metal cation, a bivalent cation, a trivalent cation or a mixture thereof, n is the valence of the cation, w is the number of water molecules per unit cell, y is a number from 0.8 to 50 and the ratio y to x is ranging from 0.7 to 100 with at least one acid (C), from 7 to 50 wt. % of aluminum(III) sulphate at least one aluminum(III) salt, and wherein all wt. % are relative to the total weight of the composition (T), thereby obtaining a tanned hide and a waste solution; where in waste solution comprises a residual chromium content of less than 150 mq/l of chromium oxide wherein the at least one acid (C) is formic acid.

2. The method according to claim 1, wherein the zeolite (Z) is of the general formula (1): $M_{x/n}[(AlO_2)_x(SiO_2)_y]$ $wH_2O$, , wherein M is an alkali metal cation, w is a number from 1 to 10, y is a number from 0.8 to 15 and the ratio y to x is ranging from 0.7 to 6.

3. The method according to claim 1, wherein the ratio of formic acid to the zeolite (Z) is from 5 to 50% by weight.

4. The method according to claim 1, wherein the weight ratio of the aluminum(III) sulphate to the treated zeolite (Z) is greater than 0.5.

5. The method according to claim 1, wherein the composition (T) further comprises from 0.1 to 20% by weight of other ingredients selected from complexation agents and bases.

6. The method according to claim 1, wherein said method comprises the steps of:

Step 1. subjecting a hide (H) to a beam house treatment, thereby obtaining a tannable hide ($H_t$), and Step 2. treating the tannable hide ($H_t$), as formed in Step 1., with the composition (T), thereby obtaining a tanned hide and a waste solution.

7. The method according to claim 1, wherein the weight percent of the composition (T), relative to the tannable hide Ht mass to which it is added, is from 4 wt. % to 14 wt. %.

8. The method according to claim 6, wherein the weight percent of the composition (T), relative to the tannable hide Ht mass to which it is added, is from 4 wt. % to 14 wt. %.

9. The method according to claim 1, wherein the concentration of the acid (C) is 84% by weight or more.

* * * * *